US008105516B2

(12) United States Patent
Fiedler et al.

(10) Patent No.: US 8,105,516 B2
(45) Date of Patent: Jan. 31, 2012

(54) METHOD AND APPARATUS FOR PRODUCING A COAL CAKE FOR COKING

(75) Inventors: Norbert Fiedler, Friedrichsthal (DE); Peter Gross, Überherrn (DE); Franz Steiner, Beckingen (DE)

(73) Assignee: FLSmidth A/S, Valby (DK)

( * ) Notice: Subject to any disclaimer, the term of this patent is extended or adjusted under 35 U.S.C. 154(b) by 64 days.

(21) Appl. No.: 12/308,822

(22) PCT Filed: Jun. 20, 2007

(86) PCT No.: PCT/EP2007/005397

§ 371 (c)(1),
(2), (4) Date: Feb. 9, 2009

(87) PCT Pub. No.: WO2008/000374

PCT Pub. Date: Jan. 3, 2008

(65) Prior Publication Data

US 2009/0321980 A1 Dec. 31, 2009

(30) Foreign Application Priority Data

Jun. 27, 2006 (DE) ..... 10 2006 029 768

(51) Int. Cl.
*B29C 43/00* (2006.01)

(52) U.S. Cl. ..... 264/120; 425/431; 44/591; 44/620; 44/596; 44/636

(58) Field of Classification Search ..... 264/120; 425/431; 44/591, 620, 596, 636
See application file for complete search history.

(56) References Cited

U.S. PATENT DOCUMENTS

| | | | | |
|---|---|---|---|---|
| 3,892,280 | A * | 7/1975 | Klushin et al. | 173/162.1 |
| 4,082,471 | A * | 4/1978 | Hiszpanski | 404/133.1 |
| 4,108,610 | A * | 8/1978 | Leibrock | 44/596 |
| 4,128,402 | A * | 12/1978 | Leibrock et al. | 44/634 |
| 4,470,440 | A * | 9/1984 | Thor | 144/195.5 |
| 4,606,876 | A * | 8/1986 | Yoshida et al. | 264/120 |
| 5,069,842 | A * | 12/1991 | Vanvoren et al. | 264/101 |
| 5,879,421 | A * | 3/1999 | Liu et al. | 44/535 |
| 7,540,336 | B2 * | 6/2009 | Steffen | 173/162.1 |

FOREIGN PATENT DOCUMENTS

| | | |
|---|---|---|
| DE | 542 139 | 1/1932 |
| DE | 30 21 813 | 12/1981 |
| DE | 31 45 344 | 5/1983 |

OTHER PUBLICATIONS

English translation of DE 3021813 Dec. 17, 1981.*
Braun N V et al: "Ramming of a Coal Charge and Outlook for Its Use in The USSR", 1987, No. 4, 1987 pp. 1-7, XP002449501.

* cited by examiner

*Primary Examiner* — Joseph Del Sole
*Assistant Examiner* — David N Brown, II
(74) *Attorney, Agent, or Firm* — Lucas & Mercanti, LLP; Klaus P. Stoffel

(57) ABSTRACT

The invention relates to a method and apparatus for producing a coal cake for coking, in which a bed (3) of coal is compacted in a mold (2) by pulses of hammers (19) which act on the bed, and is solidified to form a block. In accordance with the invention the bed (3) is not only worked on in pulses by the hammers (19) but is also subjected to compression.

11 Claims, 3 Drawing Sheets

METHOD AND APPARATUS FOR PRODUCING A COAL CAKE FOR COKING

Figure 1:
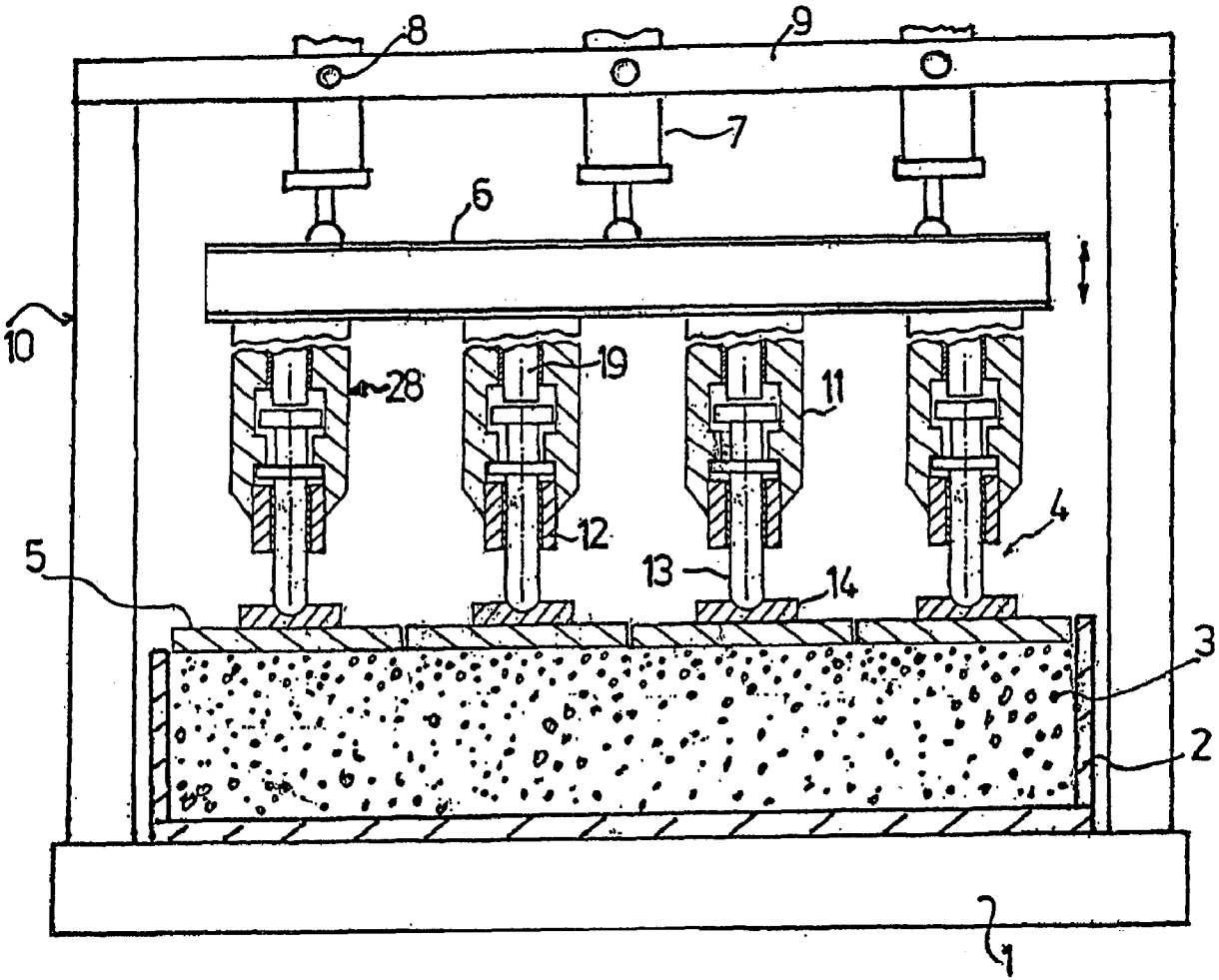

The invention relates to a method for producing a coal cake for coking, where a bed of coal is compacted in a mold by pulses of hammers that act on the bed of coal and is solidified to form a block, as well as an apparatus for accomplishing the method.

In such a method known through usage, drop hammers are used to compact the bed of coal. The degree of compaction and the uniformity of the compaction obtained in this manner are not sufficient in many cases. More especially, the strength of the molded coal block is often insufficient to enable it to be transported and inserted into a coke oven without breaking.

It is the object of the invention to improve the aforementioned method with regard to producing better compacted, stronger molded coal blocks.

This object is achieved in that a pressing pressure is exerted onto the bed of coal in addition to the pulse impingement by the hammers.

The main cause of the lack of compaction and solidification in the method according to the state of the art is the low strength and also a certain resilience of the bed of coal. Consequently, the kinetic energy of the hammers, when interacting with the bed of coal, is only partly used for deforming the grains of coal and consequently for compacting the bed. Due to a proportion of the impact being resilient, the hammer retains a considerable part of its kinetic energy and springs back.

By the bed of coal additionally being under compressive stress according to the invention, thereby being solidified and being closer to the elastic limit, the proportion of plastic deformation work passed to the grains of coal that is transmitted on impact is increased, which results in a high degree of compaction. In particular, compressive stress leads markedly to the escape of hygroscopically bound water and bitumen material from the grains of coal. Both the escaped water and also the bitumen material act as binding means, which contributes additionally to the strength of the molded coal block formed.

The pressing is preferably effected in a continuous manner during and between the transmissions of the hammer pulses. Where the compressive stress is constantly present, it is also possible for rearranging processes that increase the degree of compaction to be executed in the bed between the hammer pulses.

The extent of the pressing force or/and of the hammer pulses can be modifiable, for example in accordance with the extent of the compaction already achieved.

Whereas it is possible to exert the pressing force by means of a single pressing plate that is impinged upon at different points by hammers, the preferred specific embodiment of the invention provides pressing elements that include a plurality of pressing plates, or, where applicable, one pressing plate.

The pressing elements preferably cover at least one side of a cuboid bed completely or approximately completely.

Whereas pressing elements and hammers could act on the bed in different surface regions, in the preferred specific embodiment of the invention the pressing elements also transmit the hammer pulses onto the bed along with the pressing pressure.

The hammers therefore strike the pressing elements, the mass ratio between pressing element and hammer being selected preferably in such a manner that the hammer transmits its pulse completely to the pressing element, which then, in its turn, in a largely unresilient impact loses its pulse to the bed of coal, the kinetic energy of the hammer being converted largely into deformation work on the grains of coal of the bed.

The hammer can be a hydraulically driven hammer, such as is used, for example, in the construction industry in demolition work for destroying concrete. However, it would also be possible to use pneumatic or electric hammers or hammers driven in any other manner.

The pressing force can be transmitted to the pressing element, for example, via the housing of a hammer device that includes the hammer.

The pressing elements, including housings, can be adjustable in accordance with the compaction achieved and moreover be movable to such a degree that, through displacement, enough space to fill the mold can be created.

A series of additional advantages is produced by the method according to the invention and by the apparatus according to the invention. The high degree of solidification achievable makes it possible for types of coal to be used that up to now have not been usable.

The new method opens up greater scope to react to changing characteristics of the coal charge. The use of water as binding means, impairing the coking process, can be reduced. On account of the high degree of compaction of the coal, which can go beyond compaction into as closed as possible a structure due to the plastic deformation of the grains of coal, carbon that is generated by cracking processes during coking remains for the most part in the coal cake and is not disadvantageously deposited on the inner wall of the coke oven. The proportion of carbon in the coke gas is reduced.

In another development of the invention, the pressing elements can form a wall, in particular a vertical wall, of the mold.

Figure 2:
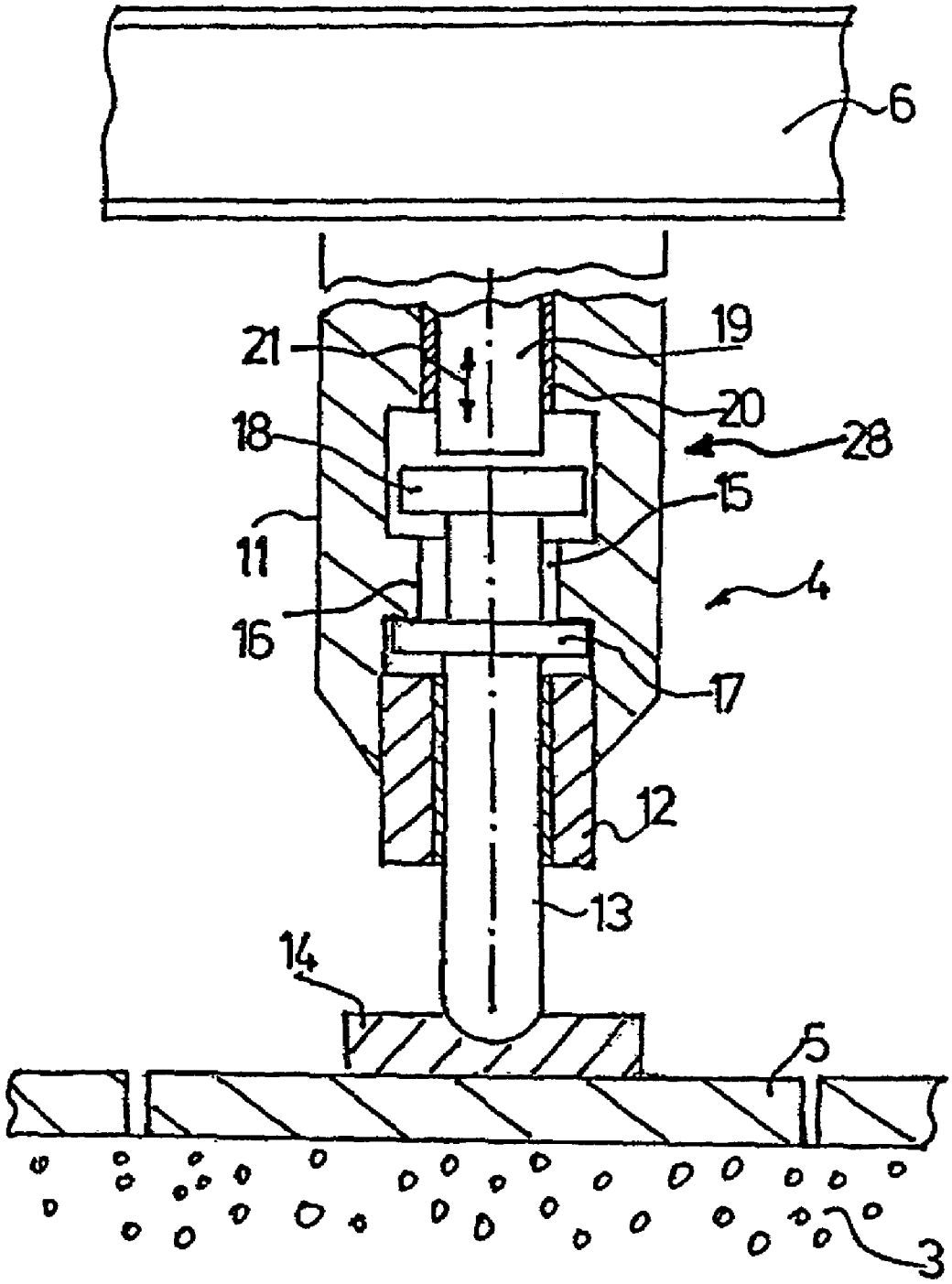
Figure 3:
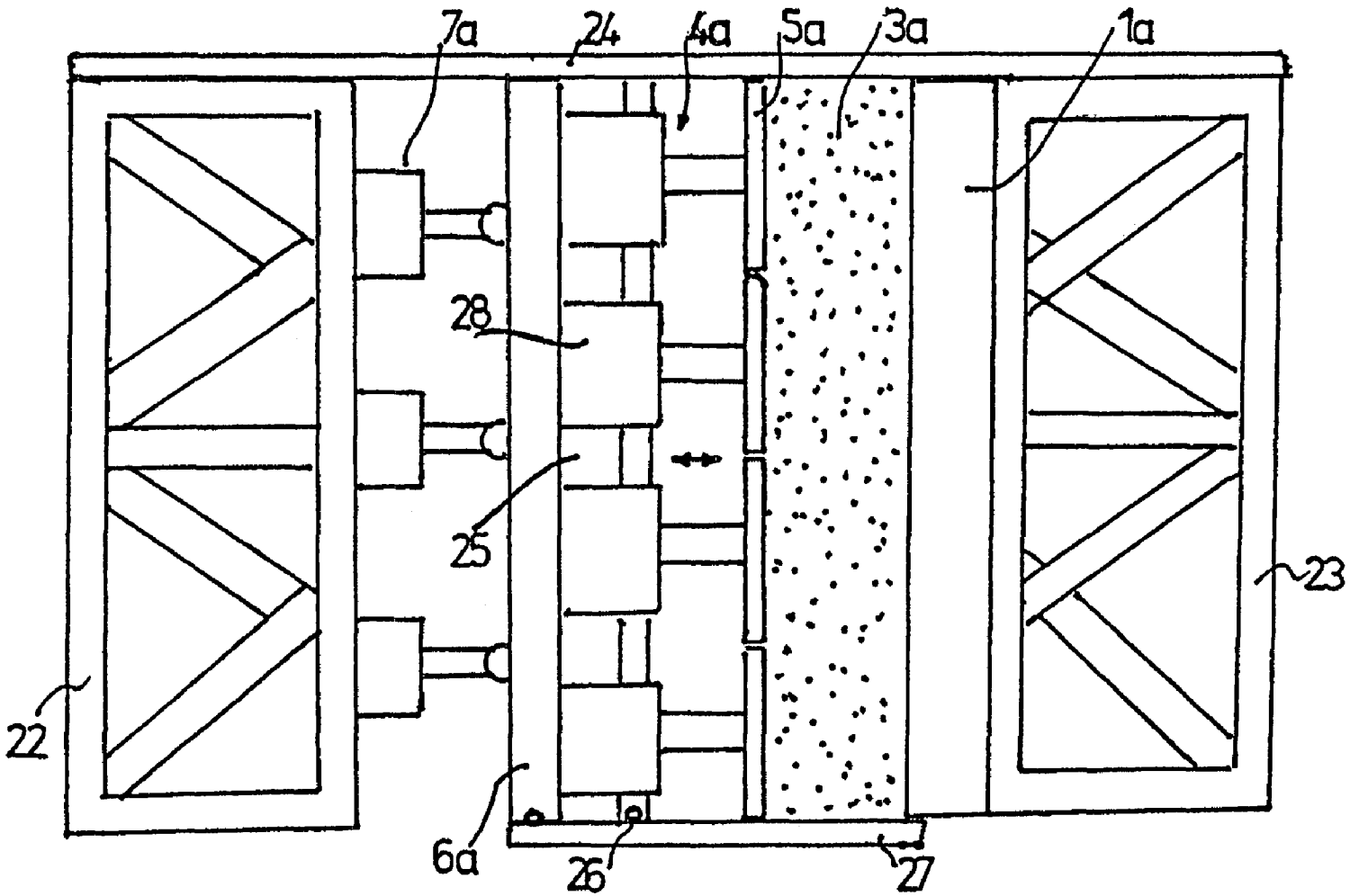

The invention is described in more detail below by way of exemplary embodiments and the enclosed drawings, which relate to said exemplary embodiments. In the drawings:

FIG. 1 is a first exemplary embodiment of an apparatus for producing a coal cake according to the invention, FIG. 2 is a part of the apparatus in FIG. 1 and FIG. 3 is a second exemplary embodiment of an apparatus according to the invention.

A mold 2 for accommodating a bed 3 made of pulverized coal is disposed on a solid base plate 1 of the apparatus shown in FIG. 1. Rams 4, each with a pressing plate 5, are provided above the box-shaped mold 2 that is open upward. In the shown state of the apparatus, the pressing plates 5 abut against the bed 3, covering the free surface of the bed almost completely.

In the exemplary embodiment described here, the pressing elements 4 are each connected to a hammer device 28 that is described in more detail in FIG. 2, the housing 11 of said hammer device being mounted on a horizontal beam 6, which can be moved vertically by means of hydraulic cylinders 7 and by means of which a pressing force generated by hydraulic cylinders 7 is transmittable to the pressing elements 4. The hydraulic cylinders 7 are connected at 8 to a horizontal portion 9 of a clamping frame 10 that is mounted on the base plate 1.

As can be seen in particular in FIG. 2, a striking pin 13 is guided in a bushing part 12 of the housing 11, the end of said striking pin remote from the housing 11 abutting loosely against a projection 14 that is connected to the pressing plate 5. A ring projection 16 protrudes from the housing 11 into a rotationally symmetrical interior 15 of the housing 11, said ring projection 16 engaging behind a ring projection 17 that is connected to the striking pin 13 such that the pressing force can be transmitted via the ring projections from the housing 11 to the striking pin 13, which forms a part of the pressing element 4, and consequently to the pressing plate 5.

A head 18 of the striking pin 13 is disposed in an upper part of the interior 15, a hammer pin 19 of the hammer device 28, coaxial to the striking pin 13, being able to impact onto said head. The hammer pin 19 that is moveable up and down in a guide 20 according to arrow 21 is in operative connection with a hydraulic drive cylinder (not shown).

To produce a coal cake, pulverized coal charge is tipped into the mold 2, and depending on the height of the coal block to be produced, the filling and processing of the bed 3 can be effected in layers or in one single operation. The pressing elements 4 are placed onto the free surface of the bed 3 and by means of the hydraulic cylinders 7 a pressing force is generated, which the beam 6 transmits onto all the housings 11 and the housings 11 transmit onto the pressing plates 5 via the striking pins 13. Along with the continuous impingement by the pressing force, working of the bed is effected in a pulse-like manner by the hammer pins 19, said hammer pins each transmitting their pulse largely onto the pressing elements 4, which include the striking pin 13 and the pressing plates 5, within a resilient impact. The pressing elements 4 deliver the received pulse onto the bed 3 within a largely unresilient impact.

The combination of pulse impingement and continuous pressing of the bed achieves a high degree of compaction and a solid coal cake block is created.

Reference is now made to FIG. 3, where identical or identically acting parts are provided with reference numbers that are identical to those shown in FIGS. 1 and 2, the letter a being added to the relevant reference number.

The exemplary embodiment in FIG. 3 differs from the preceding exemplary embodiment in that a pulse and pressing impingement of a bed 3*a* is not effected in the vertical direction but rather in the horizontal direction. A high-mass vertical base plate 1*a* and pressing plates 5*a* form side walls of a mold that accommodates the bed 3*a*.

As in the preceding exemplary embodiment, striking pins 13*a* that act on the pressing plates 5*a* are impingeable by hammer pins (not shown).

Support structures 22 and 23 are each anchored in the base and are interconnected at their top side by a tie rod 24.

The unit produced by pressing elements 4*a*, hammer devices 28*a* and beam 6*a*, which unit being strengthened by an additional vertical support 25, can be moved by means of rollers 26 on a base plate 27, which also closes the mold cavity that accommodates the bed 3*a* at the bottom.

In the exemplary embodiment shown the horizontal width of the bed 3*a* in the pressing direction is approximately 0.5 m. With this width a homogeneous compacting can be achieved over the entire bed volume. The production of the molded coal block only requires one single bed filling.

The invention claimed is:

1. A method for producing a coal cake for coking, where a bed (3) of coal is compacted in a mold (2) by repeated strikes of reciprocating hammers (19) that act on the bed (3) of coal and is solidified to form a block, wherein, in addition and simultaneously to the strikes by the hammers (19), a pressing pressure is exerted in a continuous manner during and between transmission of the hammer strikes onto the bed (3) of coal by a pressing element (4), wherein the hammers (19) reciprocate relative to the pressing element (4) and in so doing repeatedly move through empty space and strike with elastic impacts on the pressing element (4) so that each hammer strike is transmitted to the bed (3) by way of the pressing element (4) along with the pressing pressure.

2. An apparatus for producing a coal cake for coking, said apparatus having a mold (2) for accommodating a bed (3) of coal, devices for pressing the bed (3) of coal, and reciprocating hammers (19) that repeatedly act on the bed (3) of coal for compacting and solidifying the bed (3) of coal to form a block, wherein the pressing devices (4-10, 28) include a pressing element (4) that is arranged to continuously press the bed (3) of coal during and between acting of the hammers (19) on the bed (3) of coal and to be struck by the hammers (19) so as to transmit strikes by the hammers (19) onto the bed (3) together and simultaneously with the pressing pressure and wherein the hammers (19) are arranged to reciprocate relative to the pressing element (4) and while doing so to repeatedly strike with elastic impacts on the pressing element (4).

3. The apparatus as claimed in claim 2, wherein the extent of the pressing pressure, and/or of the hammer strikes is modifiable.

4. The apparatus as claimed in claim 2, wherein the pressing elements (4) include pressing plates (5) that abut against the bed (3) of coal.

5. The apparatus as claimed in claim 2, wherein the pressing elements (4; 4*a*) cover at least one side of a cuboid bed (3; 30) of coal completely or approximately completely.

6. The apparatus as claimed in claim 3, wherein the pressing elements (4) are provided additionally for transmitting strikes of the hammers (19) onto the bed (3) of coal.

7. The apparatus as claimed in claim 6, wherein a hammer (19) is associated with each pressing element (4).

8. The apparatus as claimed in claim 6, wherein the mass ratio between pressing element (4) and hammer (19) is selected in such a manner that each hammer (19) transmits its strike completely to the pressing element (4).

9. The apparatus as claimed in claim 7, wherein a pressing force can be transmitted to the pressing element (4) by means of a housing (11) of a hammer device (28) that includes the hammer (19).

10. The apparatus as claimed in claim 2, wherein the hammers (19) are hydraulically driven.

11. The apparatus as claimed claim 1, wherein the rams (4*a*) form a wall, in particular a vertical wall, of the mold (2*a*).

* * * * *